US009475070B2

(12) United States Patent
Akahira et al.

(10) Patent No.: US 9,475,070 B2
(45) Date of Patent: Oct. 25, 2016

(54) WATER FAUCET

(71) Applicant: TOTO LTD., Fukuoka (JP)

(72) Inventors: Hiromi Akahira, Kitakyushu (JP); Koji Takeda, Kitakyushu (JP); Minoru Shibata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 42 days.

(21) Appl. No.: 14/325,042

(22) Filed: Jul. 7, 2014

(65) Prior Publication Data

US 2015/0014447 A1 Jan. 15, 2015

(30) Foreign Application Priority Data

Jul. 8, 2013 (JP) ..... 2013-142866

(51) Int. Cl.

| | |
|---|---|
| ***E03C 1/084*** | (2006.01) |
| ***B05B 1/04*** | (2006.01) |
| ***E03C 1/04*** | (2006.01) |
| ***E03C 1/08*** | (2006.01) |
| ***B05B 1/12*** | (2006.01) |
| ***B05B 1/16*** | (2006.01) |
| ***B05B 1/22*** | (2006.01) |

(52) U.S. Cl.

CPC . *B05B 1/04* (2013.01); *B05B 1/12* (2013.01); *B05B 1/16* (2013.01); *B05B 1/22* (2013.01); *E03C 1/0405* (2013.01); *E03C 1/08* (2013.01)

(58) Field of Classification Search

CPC ..... E03C 1/0405; E03C 1/084; B05B 1/12; B05B 1/16; B05B 1/04; B05B 1/22; E01C 1/10–1/108

USPC ..... 239/428.5, 435

See application file for complete search history.

(56) References Cited

U.S. PATENT DOCUMENTS

| | | | | |
|---|---|---|---|---|
| 6,270,022 | B1 * | 8/2001 | Knapp | E03C 1/084 239/428.5 |
| 7,913,934 | B2 * | 3/2011 | Schorn | A61H 33/027 239/419.5 |
| 2011/0284662 | A1 * | 11/2011 | Ohashi | A47K 3/28 239/428.5 |
| 2011/0297759 | A1 * | 12/2011 | Morbio | B05B 7/0425 239/428.5 |

FOREIGN PATENT DOCUMENTS

JP 2005-226410 A 8/2005

* cited by examiner

*Primary Examiner* — Arthur O Hall
*Assistant Examiner* — Juan C Barrera
(74) *Attorney, Agent, or Firm* — Studebaker & Brackett PC

(57) ABSTRACT

The present invention aims to provide a water faucet which allows a large space to be secured above the washing area and yet can deliver a high washing performance by landing streams or waterdrops having a large cross-sectional area evenly on a piece to wash. This water faucet includes a flow velocity changing part which changes the flow velocity of the stream discharged from each of multiple water spray holes such that the cross-sectional area of the stream changes with time. The multiple water spray holes are disposed at intervals such that, when the cross-sectional area of one stream discharged from one water spray hole exceeds a predetermined size, the one stream is merged with one of the other streams discharged from the multiple other water spray holes adjacent to the one water spray hole, and such that the one of the other streams with which the one stream merges changes with time.

17 Claims, 11 Drawing Sheets

FRONT SIDE ← → BACK SIDE

WATER FAUCET

BACKGROUND OF THE INVENTION

1. Field of the Invention

The present invention relates to a water faucet which is used for a kitchen and supplies water.

2. Description of the Related Art

As a common water faucet used for a kitchen, the one described in Japanese Patent Laid-Open No. 2007-170135 is known. When used, this water faucet is mounted on an upper surface of a kitchen, etc.; a part of the water faucet extends toward a sink side of the kitchen and is provided with a showerhead at the leading end. Multiple water spray holes are bored in the lower surface of the showerhead, and streams discharged through the water spray holes are supplied in the form of a shower downward to the sink.

The water faucet described in Japanese Patent Laid-Open No. 2007-170135 has a problem in terms of work efficiency. That is, since the showerhead overhangs the sink and supplies a shower stream almost directly downward, a large piece to wash cannot be disposed within the space between the sink and the showerhead and the washing work becomes difficult.

As a solution to the above work efficiency problem, a water faucet described in Japanese Patent No. 4449083 has been proposed. This water faucet includes a water discharge part which extends upward with an inclination toward a user side, and multiple water spray holes are bored in the sink-side outer surface of this water discharge part. Streams discharged through the water spray holes are supplied as a shower stream obliquely downward to the front side of where the user stands.

The shower stream supplied with an inclination from the water discharge part passes obliquely through a washing area, which is the middle part between the sink front surface and the sink back surface and in which the user performs washing work. Thus, it is possible to secure a large space, unobstructed by the water discharge part, above the washing area. This makes it easier to dispose even a large piece to wash within the washing area and perform the washing work.

The water faucet described in Japanese Patent No. 4449083 requires that the flow velocity of the stream discharged from each of the multiple water spray holes be equal to or higher than a predetermined value. This is because when the flow velocity is below the predetermined value, the shower stream fails to reach the washing area and instead passes through the sink back surface side behind the washing area. This requirement is characteristic of the form of the water faucet which supplies a shower stream obliquely downward to the front side; such a requirement is not imposed on the form of the water faucet, like the one described in Japanese Patent Laid-Open No. 2007-170135, which supplies a shower stream almost directly downward from the showerhead.

The simplest way to achieve the flow velocity of the stream discharged from each water spray hole which is equal to or higher than a predetermined value, at which the shower stream can reach the washing area, is to make the total cross-sectional area of the multiple water spray holes and the cross-sectional area of each water spray hole relatively small. In this case, however, a stream having a small cross-sectional area (thin stream) is discharged from each water spray hole, and this stream keeps landing on a piece to wash almost at the same position therein, which makes it difficult, for example, to scrape dirt off the piece to wash.

Having been made in view of such problems, the present invention aims to provide a water faucet which allows a large space to be secured above the washing area and yet can deliver a high washing performance by landing streams or waterdrops having a large cross-sectional area evenly on a piece to wash.

SUMMARY OF THE INVENTION

In order to solve the above problems, a water faucet according to the present invention, which is a water faucet used for a kitchen, includes: a mounting part which is mounted on a mounting surface; a shower water discharge part, provided above the mounting part, which has multiple water spray holes and supplies multiple streams discharged from the multiple water spray holes as a shower stream obliquely downward to the front side of where a user stands; and a flow velocity changing part which changes the flow velocity of the stream discharged from each of the multiple water spray holes such that the cross-sectional area of the stream changes with time, wherein the multiple water spray holes are disposed at intervals such that, when the cross-sectional area of one stream discharged from one water spray hole exceeds a predetermined size, the one stream is merged with one of the other streams discharged from the multiple other water spray holes adjacent to the one water spray hole, and such that the one of the other streams with which the one stream merges changes with time.

In the water faucet according to the present invention, one stream discharged from one water spray hole of the multiple water spray holes changes in cross-sectional area with time. The multiple water spray holes are disposed at intervals such that, when the cross-sectional area of one stream exceeds a predetermined size, the one stream is merged with one of the other streams discharged from the multiple other water spray holes adjacent to the one water spray hole. As a result of this merging, the water having become a stream with a large cross-sectional area or large waterdrops land on a piece to wash, so that even persistent dirt adhering to the piece to wash can be scraped off. As the other stream with which the one stream merges changes with time, a change occurs in the traveling direction of the stream at the time of merging, so that a piece to wash can be washed evenly by landing the stream on the piece at varying positions over time. That is, according to the present invention, it is possible to improve the efficiency in washing work by supplying a shower stream obliquely downward to the front side of where the user stands, and yet to achieve improved washing performance.

In the water faucet according to the present invention, it is also preferable that the flow velocity changing part includes a bubble entraining part which entrains bubbles into the water on the upstream side of the multiple water spray holes to turn the water into bubble-entrained water.

In this preferred embodiment, the flow velocity of the streams discharged from the multiple water spray holes can be changed by a simple configuration without using an actuator such as a pump. Bubbles entrained in water shows unstable behavior, such as combining with each other or moving in an unpredictable direction, unless they are attached onto a wall surface, etc. Such behavior of bubbles in water can be harnessed to change the flow velocity difference, which is a difference in the changing flow velocity, with time. By means of this temporal change in the flow velocity difference, the other stream with which the one stream merges can be changed with time, which makes it possible to evenly wash the piece to wash by landing the merged stream on the piece at varying positions over time.

In the water faucet according to the present invention, it is also preferable that the flow velocity changing part includes a bubble adjusting part which adjusts the size of the bubbles entrained in the bubble-entrained water by agitating the bubble-entrained water.

In this preferred embodiment, agitating the bubble-entrained water promotes combination or breakup of the bubbles inside the bubble-entrained water, so that bubbles of various sizes can be generated. By means of these bubbles different in size, the flow velocity difference of the streams discharged from the water spray holes can be reliably changed with time.

In the water faucet according to the present invention, it is also preferable that the bubble adjusting part is provided near the water spray holes.

If the distance from the bubble adjusting part for agitating the bubble-entrained water to the multiple water spray holes is long, the bubbles inside the bubble-entrained water combine into large bubbles while the water entraining bubbles is flowing from the bubble adjusting part to the water spray holes. When almost all the bubbles have become larger than the water spray holes, the temporal change in the flow velocity difference of the streams discharged from the water spray holes can become insufficient.

In this preferred embodiment, therefore, as the bubble adjusting part is provided near the multiple water spray holes, the bubbles of various sizes generated in the bubble adjusting part are discharged from the water spray holes before they can combine with each other, so that the flow velocity difference of the streams discharged from the water spray holes can be reliably changed with time.

In the water faucet according to the present invention, it is also preferable that the bubble entraining part has: an injection part which increases the flow velocity of the water supplied from the upstream side and injects the water to the downstream side as an injection stream; an air suction part which suctions air by means of a negative pressure developing with the passage of the injection stream; and an air entraining part which entrains the air introduced from the air suction part into the injection stream, and that the bubble adjusting part brings the injection stream injected from the injection part, which is provided on the upstream side of and near the shower water discharge part, into collision against an inner wall surface of the shower water discharge part.

In this preferred embodiment, as the air is suctioned using the ejector action of the injection stream and entrained into the injection stream, the bubble-entrained water can be produced by a simpler configuration.

In the water faucet according to the present invention, it is also preferable that the injection part is provided with multiple injection ports, and that the multiple injection ports are disposed such that the injection streams injected by the respective injection ports collide against the inner wall surface of the shower water discharge part at different positions.

In this preferred embodiment, the provision of the multiple injection ports for injecting the injection streams allows the cross-sectional area of each injection stream to be made smaller, compared with that of an injection stream when a single injection port is provided, in order to cause the ejector action. Accordingly, the bubbles entrained into each injection stream can also be made relatively smaller. As the multiple injection streams collide against the inner wall surface of the shower water discharge part at different positions, it is unlikely that these small bubbles combine into excessively large bubbles when the colliding injection streams merge with each other. Thus, the flow velocity difference of the streams discharged from the water spray holes can be reliably changed with time.

In the water faucet according to the present invention, it is also preferable that the water faucet further includes a backflow preventing part, which prevents the injection stream colliding against the inner wall surface of the shower water discharge part from flowing backward to the injection part, between the injection part and the shower water discharge part.

When the injection stream collides against the inner wall surface of the shower water discharge part and creates a backflow, the distance over which the bubble-entrained water flows before being discharged from the multiple water spray holes becomes longer, and the bubbles tend to combine into large bubbles in the meantime. In this preferred embodiment, therefore, the backflow preventing part for preventing a backflow toward the injection part is provided, so that the distance over which the bubble-entrained water flows before being discharged from the multiple water spray holes can be shortened. Thus, it is possible to suppress combination of the bubbles into excessively large bubbles, and to reliably change with time the flow velocity difference of the streams discharged from the multiple water spray holes.

DETAILED DESCRIPTION OF THE PREFERRED EMBODIMENTS

Figure 1:
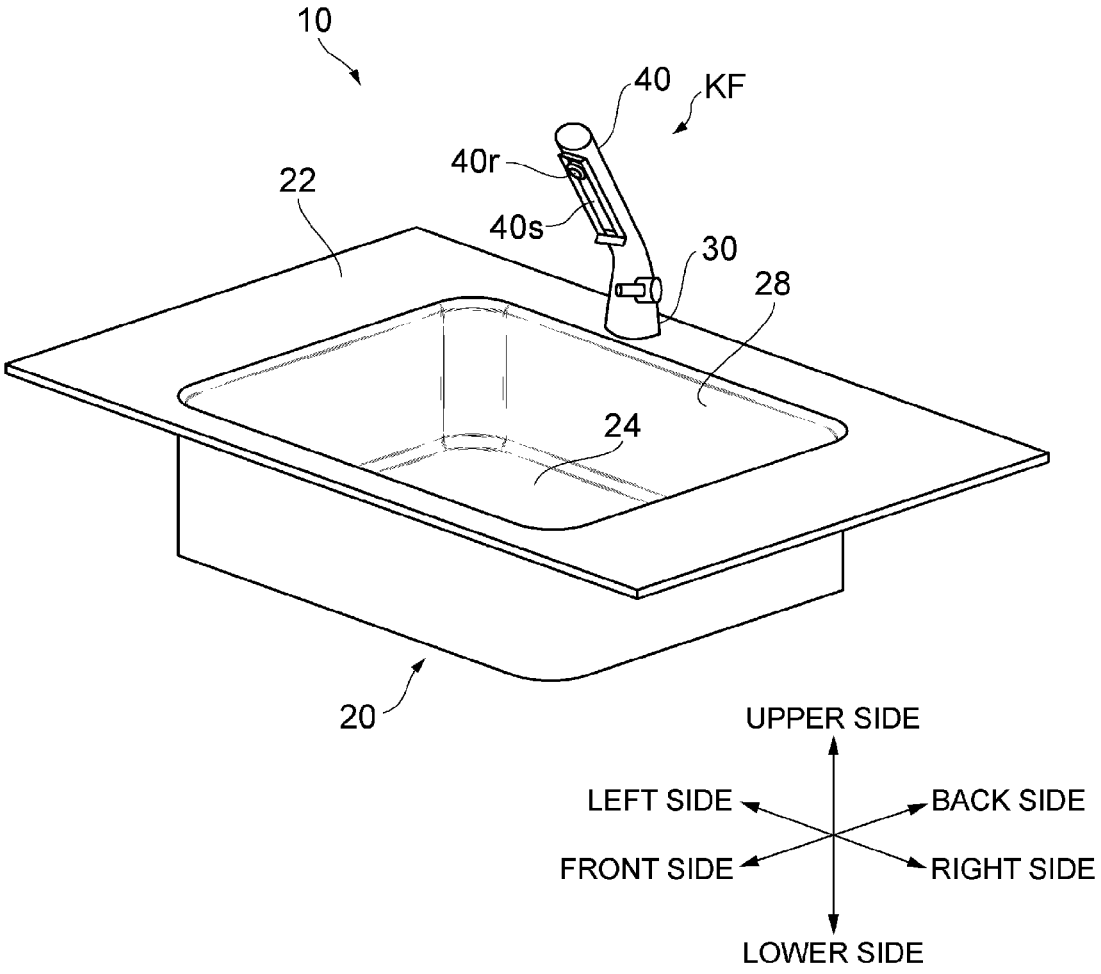
FIG. 1 is a schematic view representing a system kitchen according to an embodiment of the present invention.

In the following, an embodiment of the present invention will be described with reference to the accompanying drawings. For easy understanding, the same components in the drawings are denoted by the same reference sign as far as possible, and an overlapping description will be omitted.

First, the state of use of a water faucet according to the embodiment of the present invention will be described with reference to FIG. 1. FIG. 1 is a schematic view representing a system kitchen according to the embodiment of the present invention.

A system kitchen 10 includes a sink 20 and a water faucet KF which is mounted on this sink 20 when used.

The sink 20 has a sink upper surface 22 and a sink bottom surface 24. The sink 20 may have a cooking table (not shown) which extends at least either on the left side or the right side of the sink upper surface 22.

The water faucet KF is provided on the sink upper surface 22, on the far side of the sink 20 when viewed from a user, namely, on the back side of the system kitchen 10. The water faucet KF has a mounting part 30 which is mounted on the sink upper surface 22, and a spout part 40 provided above the mounting part 30. The mounting part 30 is provided substantially perpendicular to the sink upper surface 22, while the spout part 40 extends upward so as to be inclined toward the front side of where the user stands. The inclination angle is, for example, approximately 60 degrees to the sink upper surface 22, although this inclination angle can be arbitrarily changed.

A straight water discharge part 40*r* and a shower water discharge part 40*s* are provided on the front-side outer surface of the spout part 40. Since the front-side outer surface of the spout part 40 is inclined with respect to the sink upper surface 22 and the sink bottom surface 24, the water supplied from the straight water discharge part 40*r* and the shower water discharge part 40*s* provided on the front-side outer surface is in either case supplied obliquely to the sink upper surface 22 and the sink bottom surface 24. The term water in this description shall include hot water.

Figure 2:
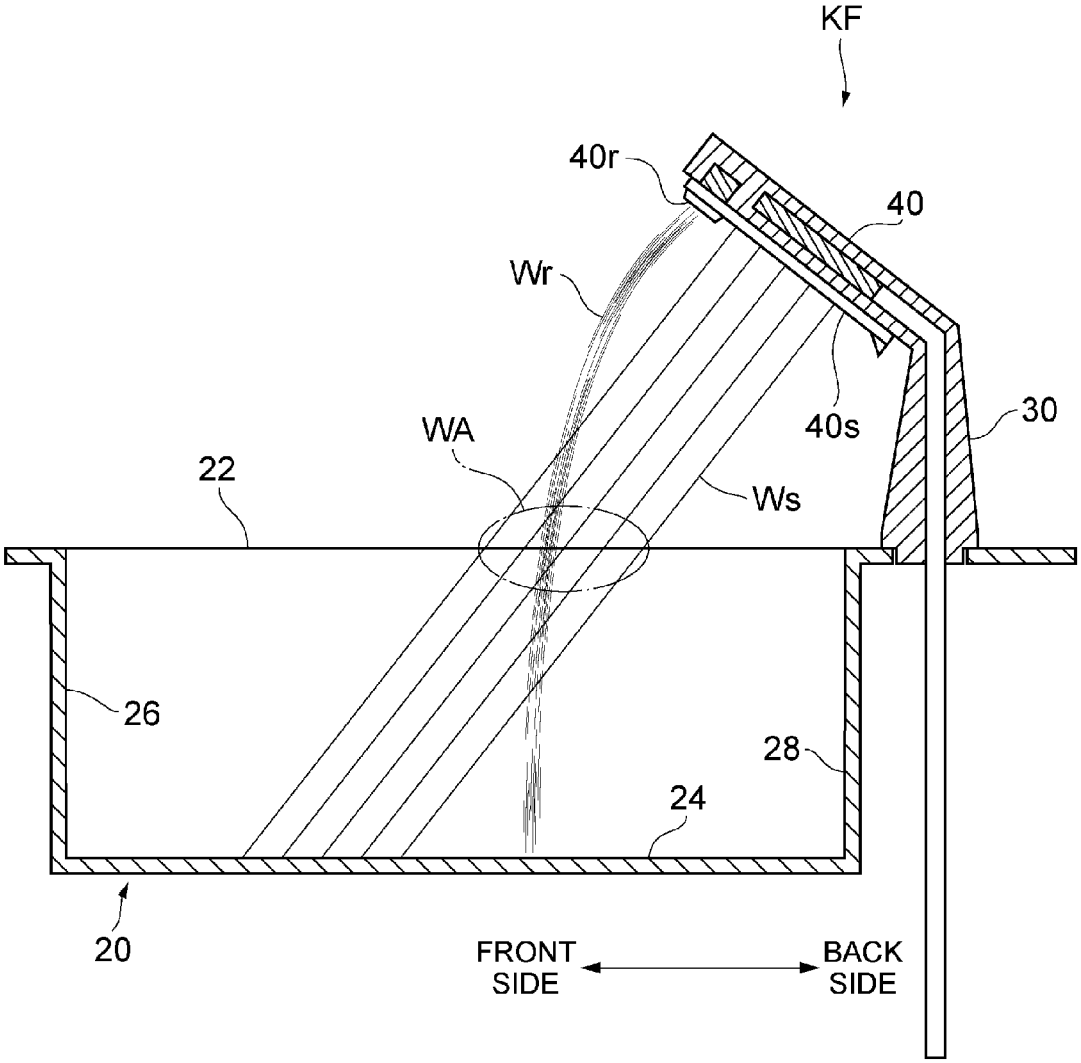
FIG. 2 is a schematic side view representing a state where a shower stream is spouted from a water faucet according to the embodiment.

Next, a supply of a shower stream from the water faucet according to the embodiment of the present invention will be described with reference to FIG. 2. FIG. 2 is a schematic side view representing a state where the shower stream is supplied from the water faucet according to the embodiment.

As shown in FIG. 2, when the water at a flow rate of a predetermined value or higher is supplied to the water faucet KF and is supplied from the shower water discharge part 40*s*, the water is supplied toward the sink 20 as a shower stream Ws formed of multiple streams. The shower stream Ws is supplied toward the sink upper surface 22, and passes through an area (hereinafter called a "washing area") WA where the sink upper surface 22 and the middle part between the sink front surface 26 and the sink back surface 28 intersect with each other.

The shower stream Ws supplied obliquely from the shower water discharge part 40*s* passes through the washing area WA with an inclination. Thus, unlike the common water faucet which supplies water directly downward from the spout, in the water faucet KF, the spout part 40 does not overhang the washing area WA. It is therefore possible to secure a large space above the washing area WA, which makes it easier to dispose even a large piece to wash within the washing area WA and perform the washing work.

On the other hand, when the water at a flow rate of a predetermined value or higher is supplied to the water faucet KF and is supplied from the straight water discharge part 40*r*, the water is supplied toward the sink 20 as a straight stream Wr, which is a single stream. The straight water discharge part 40*r* is disposed above and in front of the shower water discharge part 40*s*, behind the washing area WA. As with the shower stream Ws, the straight stream Wr supplied from the straight water discharge part 40*r* passes through the washing area WA. Thus, the user can wash the piece to wash without moving it from the washing area WA according to the form of water discharge, so that the efficiency in the washing work can be improved.

Figure 3:
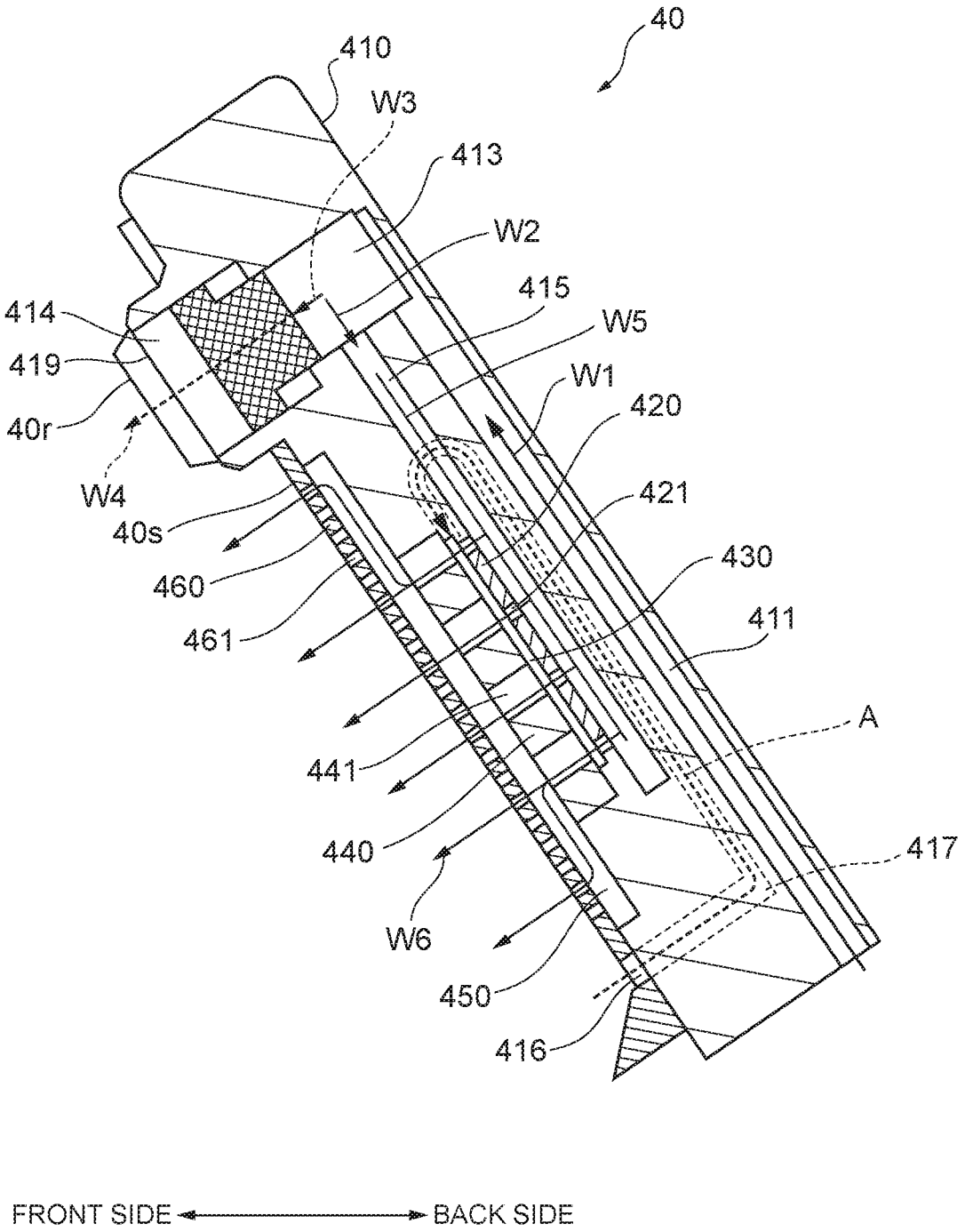
FIG. 3 is a cross-sectional view of a spout part of the water faucet according to the embodiment.

Next, the spout part of the water faucet according to the embodiment of the present invention will be described with reference to FIG. 3. FIG. 3 is a cross-sectional view of the spout part of the water faucet according to the embodiment.

The spout part 40 has a spout main body 410 which is substantially columnar in outline. Inside the spout main body 410 is provided a water supply passage 411, which extends obliquely upward along the extension direction of the spout part 40, and the water supplied from the upstream side flows inside the water supply passage 411 to be guided obliquely upward.

A switching room 413, which is a space for receiving the water having flowed through the water supply passage 411, is formed at the downstream-side end of the water supply passage 411 at the upper end inside the spout main body 410. On the downstream side of the switching room 413, a straight stream passage 414 and a shower stream passage 415 are provided so as to communicate with the switching room 413. The straight stream passage 414 extends toward the sink 20, while the shower stream passage 415 extends obliquely downward along the extension direction of the spout part 40.

A switching valve (not shown) is disposed inside the switching room 413, and the switching valve is configured such that whether the water flowing out of the switching room 413 is to be guided to the straight stream passage 414 or the shower stream passage 415 can be selected by the user's operation.

When the switching valve is set so as to guide the water inside the switching room 413 to the straight stream passage 414, the water passes, as indicated by the arrow W3, through a mesh-like straightening net 419 disposed inside the straight stream passage 414 and is further supplied, as indicated by the arrow W4, from the straight water discharge part 40*r* downward to the sink 20 (not shown in FIG. 3). In this case, the supplied straight stream Wr forms a single stream as shown in FIG. 2.

On the other hand, when the switching valve is set so as to guide the water inside the switching room 413 to the shower stream passage 415, the water flowing into the shower stream passage 415 as indicated by the arrow W5 reaches an injection plate 420 disposed on the downstream side of the shower stream passage. The injection plate 420 is a thin plate-like member extending along the extension direction of the spout part 40, and multiple injection ports 421 are formed so as to penetrate the injection plate 420 in the thickness direction. The water having reached the injection plate 420 is increased in flow velocity while passing through the multiple injection ports 421, and is injected to the downstream side as multiple injection streams.

A throat member 440 is disposed on the downstream side of the injection plate 420 at a predetermined distance from the injection plate 420. The throat member 440 has multiple throats 441 formed at positions corresponding to the multiple injection ports 421 of the injection plate 420. Thus, the injection streams injected from the multiple injection ports 421 pass through the respective throats 441 provided on the downstream side before reaching the downstream side of the throat member 440.

Here, an air introduction port 416 is bored in the front-side outer surface of the spout main body 410. In addition, an air introduction path 417 is formed inside the spout main body 410 so as to extend from the air introduction port 416 toward the middle part of the spout main body 410 and further extend obliquely upward along the extension direction of the spout part 40. The air introduction path 417 communicates with an air suction room 430, which is a space formed between the injection plate 420 and the throat member 440.

Thus, a negative pressure, which develops as the injection streams injected from the multiple injection ports 421 pass through the air suction room 430, causes the air to be suctioned into the air suction room 430 through the air introduction port 416 and the air introduction path 417. The suctioned air passes through the multiple throats 441 along with the injection streams and reaches the downstream side of the throat member 440.

On the downstream side of the throat member 440, an air entraining room 450 which is a larger space than the throat member 440 is formed, and a water spray plate 460 is disposed so as to cover the downstream side of the air entraining room 450. The water spray plate 460 is a plate-like member extending along the extension direction of the spout part 40, and constitutes the shower water discharge part 40*s*. In addition, multiple water spray holes 461 are formed so as to penetrate the water spray plate 460 in the thickness direction.

As will be described later, in the air entraining room 450, the air is entrained into the injection streams having passed through the multiple throats 441 along with the air suctioned into the air suction room 430. The air is entrained as bubbles into the injection streams. This bubble-entrained water, which is water with bubbles mixed in it, passes through each of the multiple water spray holes 461, and as indicated by the arrow W6, is discharged to the outside of the spout main body 410 as multiple streams. The shower stream formed of these multiple streams is supplied toward the sink 20 (not shown in FIG. 3).

Figure 4:
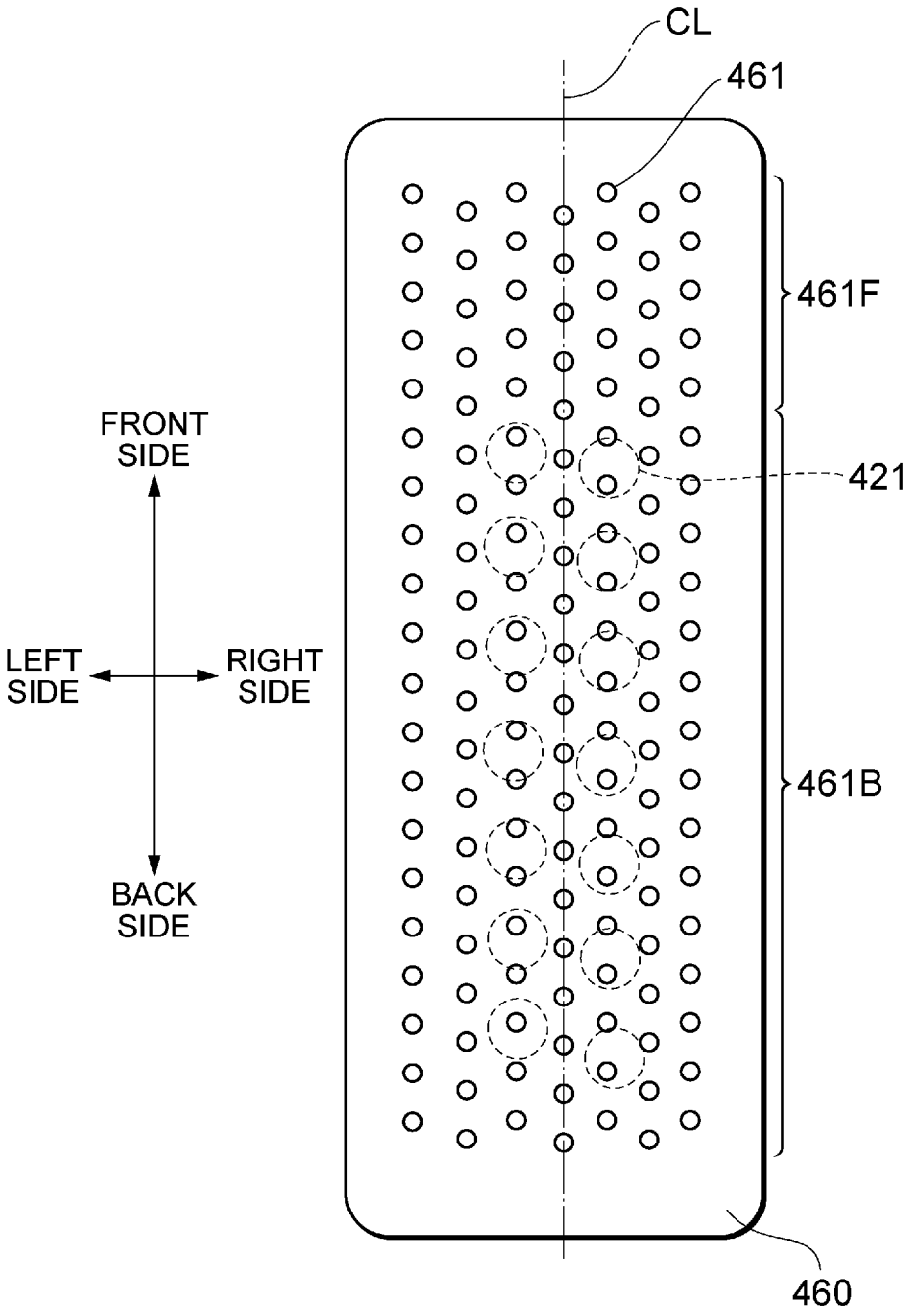
FIG. 4 is a schematic view of a water spray plate of the water faucet according to the embodiment in a direction in which injection ports inject injection streams.

Next, the water spray plate of the water faucet according to the embodiment of the present invention will be described with reference to FIG. 4. FIG. 4 is a schematic view of the water spray plate of the water faucet according to the embodiment in the direction in which the injection ports inject the injection streams.

The water spray plate 460 is formed such that its dimension in the length direction (front-back direction) is larger than its dimension in the width direction (left-right direction). The multiple water spray holes 461, which penetrate this water spray plate 460 in the thickness direction (depth direction in the drawing), are each substantially circular in cross-section and arranged in seven rows along the front-back direction so as to be symmetrical with respect to a center line CL passing through the center in the width direction of the water spray plate 460. The multiple water spray holes 461 constitute a front-side water spray hole group 461F provided on the front side, and a back-side water spray hole group 461B provided farther on the back side than the front-side water spray hole group 461F.

In FIG. 4, the multiple injection ports 421 of the injection plate 420 provided on the upstream side (on the far side in the depth direction in the drawing) of the water spray plate 460 are indicated by the dashed line. The cross-sectional shape of the injection port 421 is substantially circular with a diameter larger than that of the water spray hole 461. The injection port 421 is configured so as to inject the injection stream toward the back-side water spray hole group 461B. In addition, the injection ports 421 are disposed such that, when viewed in the direction in which the multiple injection ports 421 inject the injection streams, the injection port 421 and at least a part of the water spray holes 461 constituting the back-side water spray hole group 461B overlap. On the other hand, no overlap with the injection ports 421 occurs in the water spray holes 461 constituting the front-side water spray hole group 461F. Unlike the water spray holes 461, the arrangement of the injection ports 421 is not symmetrical with respect to the center line CL.

Figure 5:
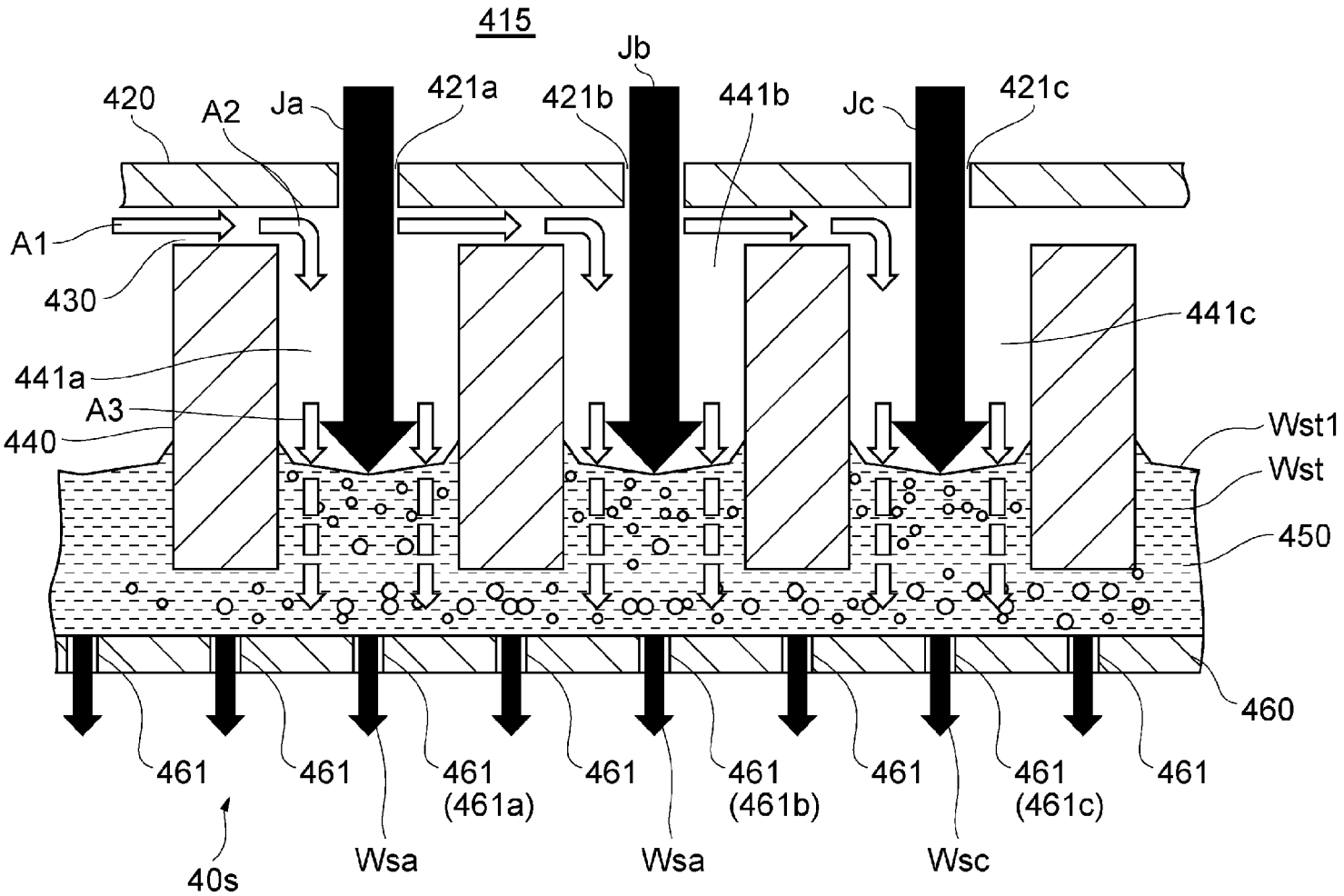
FIG. 5 is a schematic view showing the portion around the water spray plate of the water faucet according to the embodiment.
Figure 6:
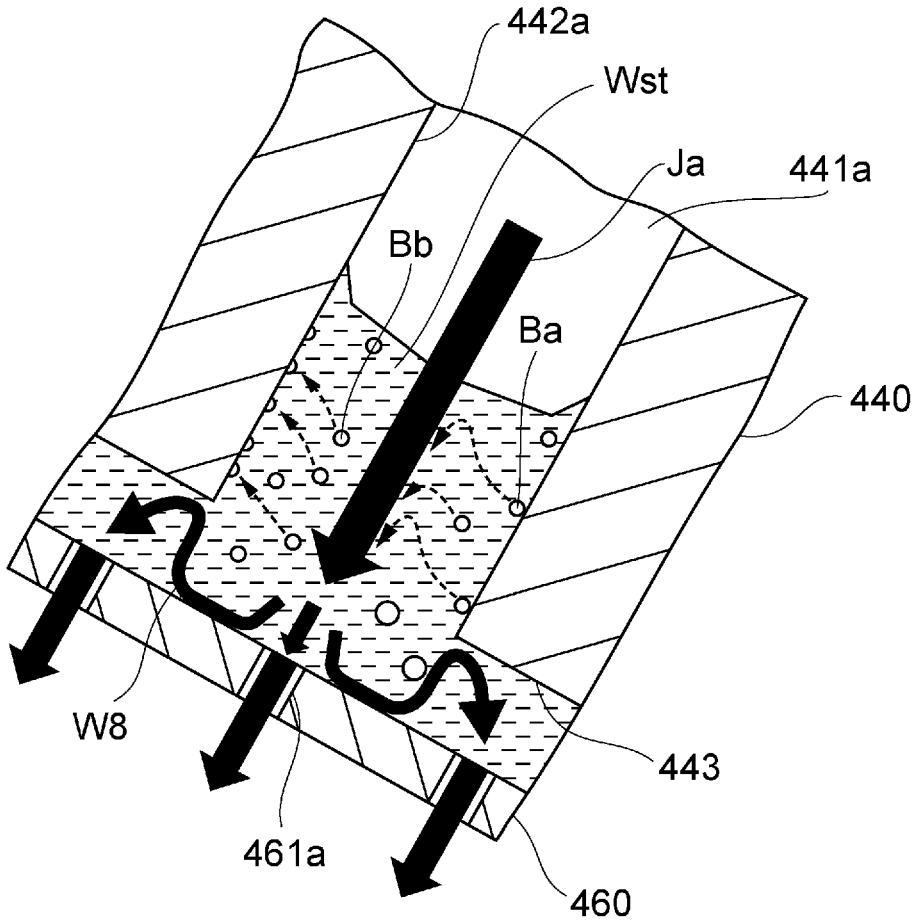
FIG. 6 is a schematic view showing a backflow near the water spray plate of the water faucet according to the embodiment.

Next, air entrainment in the water faucet according to the embodiment of the present invention will be described with reference to FIG. 5 and FIG. 6. FIG. 5 is a schematic view showing the portion around the water spray plate of the water faucet according to the embodiment, and FIG. 6 is a schematic view showing a backflow near the water spray plate of the water faucet according to the embodiment.

As shown in FIG. 5, the water flowing through the shower stream passage 415 inside the spout main body 410 and reaching the injection plate 420 passes through injection ports 421*a* to 421*c* and is injected as injection streams Ja to Jc to the downstream side of the injection plate 420. The injection ports 421*a* to 421*c* penetrate the injection plate 420 substantially in parallel with one another, so that the injection streams Ja to Jc passing through the water injection ports 421*a* to 421*c* are also injected substantially in parallel with one another. The injection ports 421*a* to 421*c* are disposed such that the injection streams Ja to Jc injected respectively from the injection ports 421*a* to 421*c* collide against the water spray plate 460 at different positions.

When the injection streams Ja to Jc pass through the air suction room 430 provided between the injection plate 420 and the throat member 440, a negative pressure develops accordingly inside the air suction room 430 (the inside of the air suction room 430 is placed under negative pressure). Thus, due to the so-called ejector action, the air is suctioned into the air suction room 430 along the injection plate 420 as indicated by the arrows A1. This air is the air which is suctioned from the outside of the spout main body 410 through the air introduction port 416 and the air introduction path 417 (not shown in FIG. 5).

The air suctioned into the air suction room 430 is further suctioned to the inside by the injection streams Ja to Jc, changes its flow direction (arrows A2), and flows into throats 441*a* to 441*c* along with the injection streams Ja to Jc.

As described above, the cross-sectional shape of the injection ports 421*a* to 421*c* is substantially circular with a diameter larger than that of the water spray hole 461. Accordingly, the cross-sectional shape of the injection streams Ja to Jc injected from the injection ports 421*a* to 421*c* is also substantially circular with a diameter larger than that of the water spray hole 461. Therefore, while part of the water of the injection streams Ja to Jc passes through the water spray holes 461*a* to 461*c* disposed so as to overlap respectively with the injection ports 421*a* to 421*c* as indicated by the arrows Wsa to Wsc, the rest of the water interfere with the water spray plate 460 and cannot directly pass through the water spray holes 461*a* to 461*c*. On the upstream side of the water spray plate 460, these injection streams failing to pass through the water spray holes are temporarily retained (retained water Wst).

After a lapse of a predetermined time since injection of the injection streams Ja to Jc has started in the injection ports 421*a* to 421*c*, the water level of the retained water Wst rises and the gas-liquid interface Wst1 enters inside the throats 441*a* to 441*c*. Thus, inside the throats 441*a* to 441*c*, the injection streams Ja to Jc rush into the gas-liquid interface Wst1 of the retained water Wst. The rush of the injection streams Ja to Jc significantly disturbs the gas-liquid interface Wst1, causing the air above the gas-liquid interface Wst1 to be involved to the inside of the retained water as indicated by the arrows A3. As the air involved to the inside of the retained water Wst turns into bubbles, the retained water Wst turns into bubble-entrained water.

As the injection streams Ja to Jc rush into the retained water, the bubble-entrained water is agitated near the multiple water spray holes 461 of the water spray plate 460. This agitation promotes combination or breakup of the bubbles in the bubble-entrained water, so that bubbles of various sizes are generated. Thus, the bubble-entrained water, into which bubbles of various sizes are entrained, is discharged from the multiple water spray holes 461.

As described above, the injection ports 421 are configured so as to inject the injection streams toward the back-side water spray hole group 461B. Thus, the water pressure near the back-side water spray hole group 461B is increased so that the bubbles entrained by the air entraining room 450 can be easily discharged from the back-side water spray hole group 461B. In this way, movement of the bubbles toward the front-side water spray hole group 461A is suppressed.

As shown in FIG. 6, an end face 443 which is a flat surface facing the water spray plate 460 is provided in the outer surface of the throat member 440. This end face 443 of the throat member 440 serves to prevent the injection streams Ja to Jc colliding against the water spray plate 460 from flowing backward to the injection ports 421*a* to 421*c* as indicated by the arrow W8. This allows shortening of the distance over which the bubble-entrained water flows before being discharged from the multiple water spray holes 461. Thus, it is possible to suppress combination of the bubbles into excessively large bubbles, and as will be described later, to reliably change the flow velocity of the streams discharged from the multiple water spray holes 461.

Figure 7:
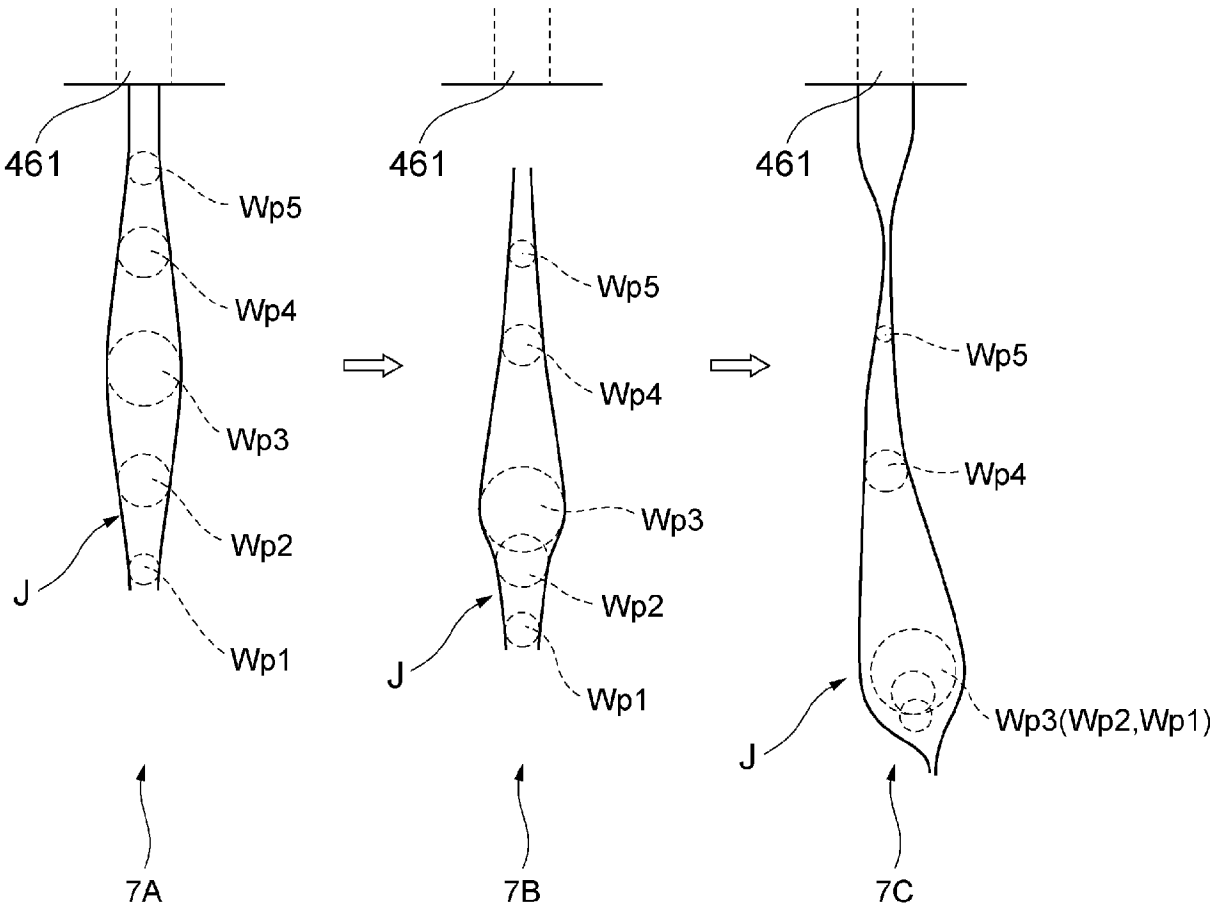
FIG. 7 is a schematic view of a stream discharged from a water spray hole of the water faucet according to the embodiment.

Next, the behavior of the stream into which bubbles are entrained will be described with reference to FIG. 7. FIG. 7 is a schematic view of a stream discharged from the water spray hole of the water faucet according to the embodiment.

In this embodiment, the flow velocity is changed, without using a large pump, etc., by entraining bubbles into the water to be discharged so as to form a large water lump.

As described above, while the bubble-entrained water is produced on the upstream side of the water spray plate 460, the amount of bubbles entrained into the water to be discharged from the multiple water spray holes 461 is not always constant due to the bubbles showing unstable behavior in water. Therefore, a change occurs in the flow velocity of the stream discharged from each of the multiple water spray holes 461. Of this stream, a portion where the amount of bubbles entrained is relatively large, the flow velocity is higher compared with another portion where the amount is relatively small.

When such a change in the flow velocity occurs within the discharged stream, the stream J injected from the water spray hole 461 turns out to include a portion Wp1, a portion Wp2, a portion Wp3, a portion Wp4, and a portion Wp5 as shown in a state 7A. When the flow velocities at these portions are respectively V1, V2, V3, V4, and V5, the following relation holds: V1 (≈V5)<V2 (≈V4)<V3.

Accordingly, as the state of the stream immediately after discharge shifts from that shown in a state 7A to that shown in a state 7C, the portion Wp3, which has a higher velocity than the portion Wp2, joins the portion Wp2 and further joins the portion Wp1 to be a large water lump.

Thus, as the portion Wp3 having the highest flow velocity sequentially joins the preceding portion Wp2 and portion Wp1, it becomes a large lump and lands on the piece to wash. This water lump appears repeatedly accompanying the repeated changes in the flow velocity of the discharged stream. It can be expected that the water having become a large water lump with large collision energy will exert a high washing capability against dirt adhering to a piece to wash.

Figures 8A, 8B, 8C:
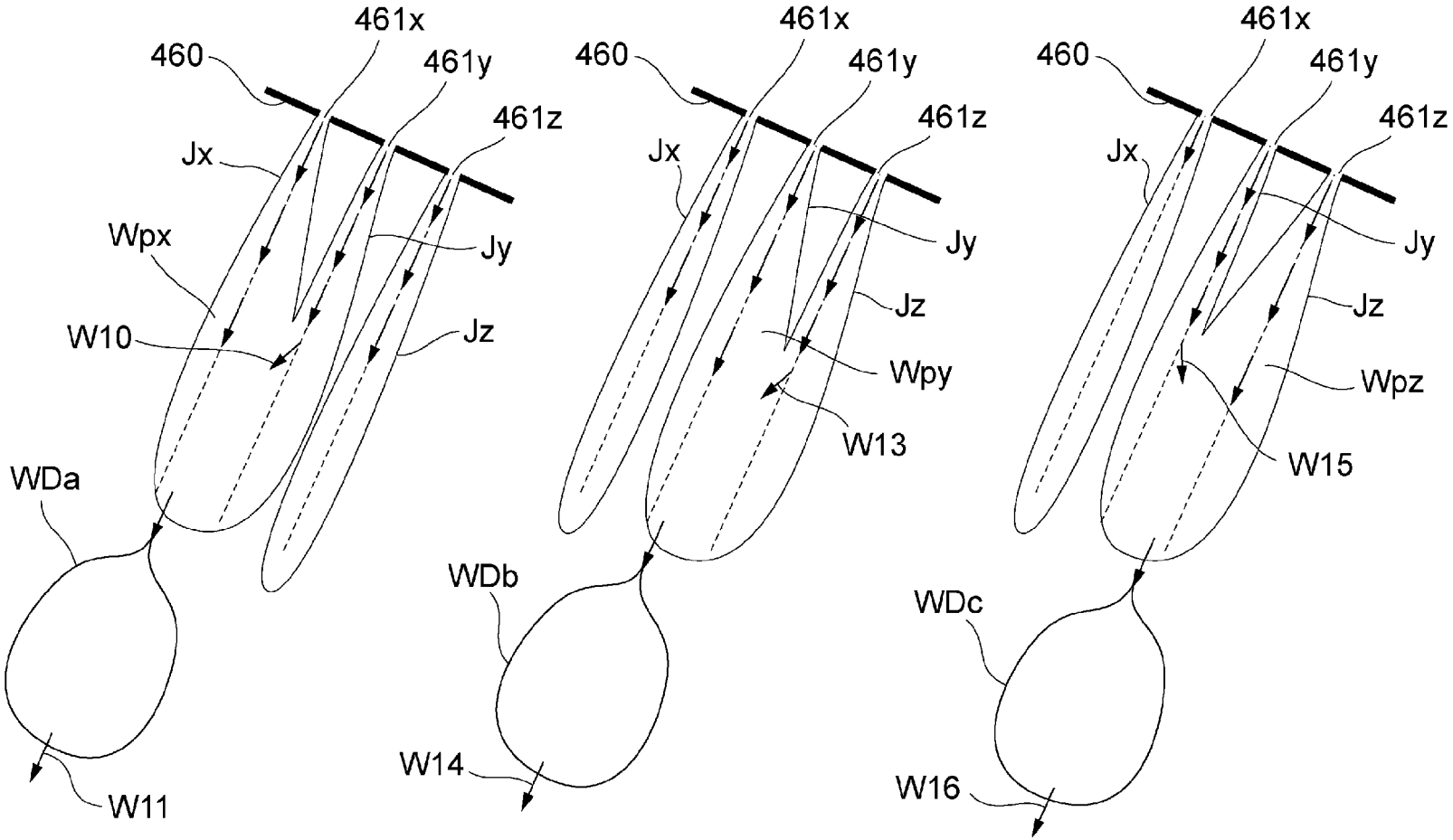
FIGS. 8A to 8C are schematic views of streams discharged from the multiple water spray holes of the water faucet according to the embodiment.

Next, the behavior of the streams in which a water lump is formed will be described with reference to FIGS. 8A, 8B, and 8C. FIGS. 8A, 8B, and 8C are schematic views of the streams discharged from the multiple water spray holes of the water faucet according to the embodiment.

As shown in FIGS. 8A, 8B, and 8C, streams Jx to Jz are discharged toward the sink 20 respectively from water spray holes 461*x* to 461*z* which are provided at predetermined intervals in the water spray plate 460. As described above, while the bubble-entrained water is supplied to the water spray holes 461*x* to 461*z* from the air entraining room 450, the amount of bubbles entrained in the bubble-entrained water supplied to each water spray hole is not always constant.

Accordingly, the amount of bubbles entrained in the bubble-entrained water supplied to the water spray hole 461*x* can be larger than that of the water spray holes 461*y* and 461*z*. In this case, as shown in FIG. 8A, a water lump Wpx is formed in the stream Jx discharged from the water spray hole 461*x*. As the stream Jx becomes locally larger in cross-sectional area in the water lump Wpx, it merges with the stream Jy discharged from the adjacent water spray hole 461*y*.

When the stream Jx and the stream Jy merge, a force pulling the stream Jy toward the stream Jx as indicated by the arrow W10 acts on the stream Jy due to the surface tension of the water lump Wpx of the stream Jx. As a result, a waterdrop WDa, which is formed on the downstream side of the merging position, is supplied in the direction of the arrow W11 with its travelling direction slightly inclined toward the direction along the arrow W10.

On the other hand, when the amount of bubbles entrained in the bubble-entrained water supplied to the water spray hole 461*y* is larger than that of the water spray holes 461*x* and 461*z*, as shown in FIG. 8B, a water lump Wpy is formed in the stream Jy. As the stream Jy becomes locally larger in cross-sectional area in the water lump Wpy, it merges with the stream Jz discharged from the adjacent water spray hole 461*z*.

When the stream Jy and the stream Jz merge, a force pulling the stream Jz toward the stream Jy as indicated by the arrow W13 acts on the stream Jz due to the surface tension of the water lump Wpy of the stream Jy. As a result, a waterdrop WDb, which is formed on the downstream side of the merging position, is supplied in the direction of the arrow W14 with its travelling direction slightly inclined toward the direction along the arrow W13.

Instead, when the amount of bubbles entrained in the bubble-entrained water supplied to the water spray hole 461*z* is larger than that of the water spray holes 461*x* and 461*y*, as shown in FIG. 8C, a water lump Wpz is formed in the stream Jz. As the stream Jz becomes locally larger in cross-sectional area in the water lump Wpz, it merges with the stream Jy discharged from the adjacent water spray hole 461*y*.

When the stream Jy and the stream Jz merge, a force pulling the stream Jy toward the stream Jz as indicated by the arrow W15 acts on the stream Jy due to the surface tension of the water lump Wpz of the stream Jz. As a result, a waterdrop WDc, which is formed on the downstream side of the merging position, is supplied in the direction of the arrow W16 with its travelling direction slightly inclined toward the direction along the arrow W15.

As the states shown in FIG. 8A to FIG. 8C appear repeatedly and randomly, many large waterdrops are supplied downward from the water spray plate 460, and at the same time, as the travelling direction of these waterdrops also change randomly, they land on a piece to wash at different positions.

Figure 9:
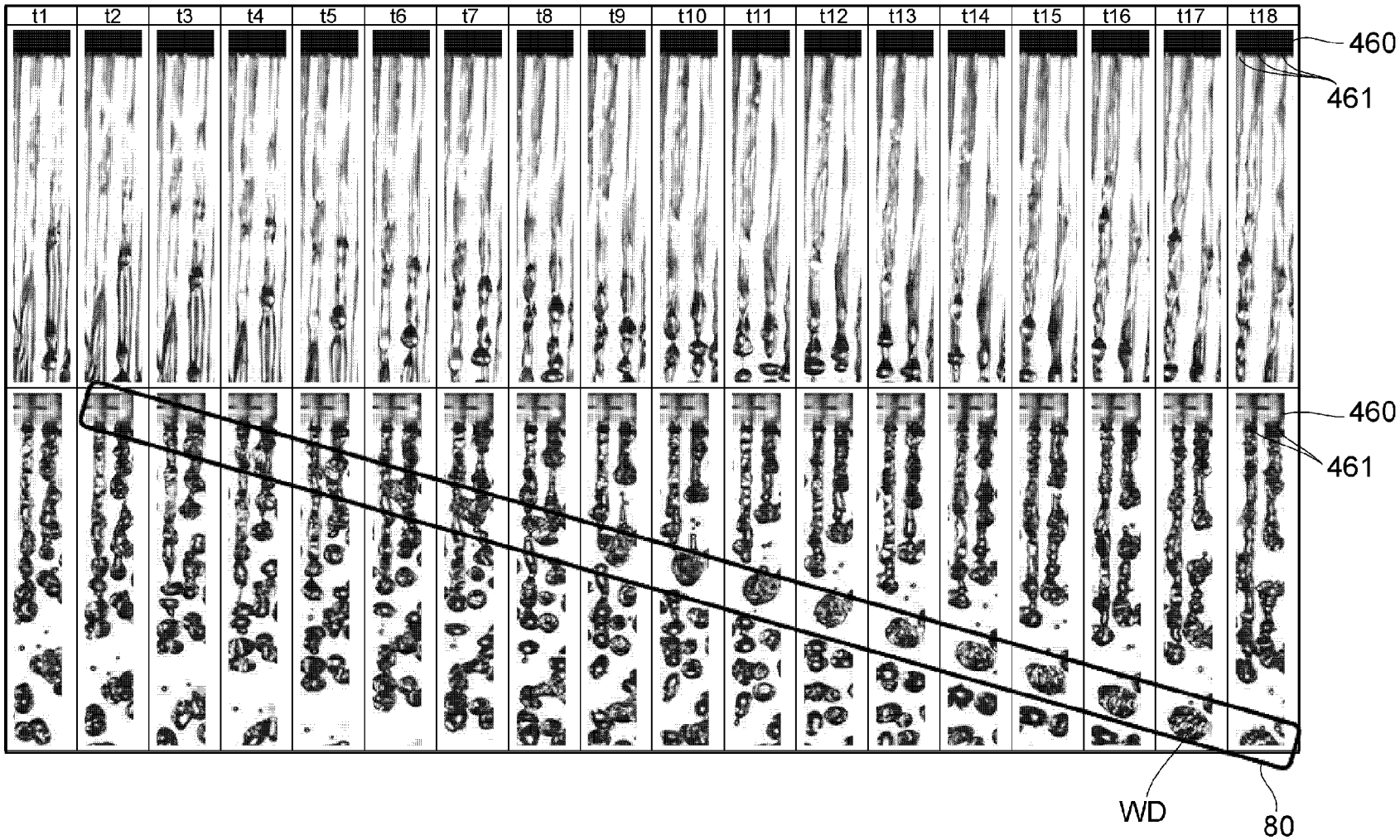
FIG. 9 is photographs of streams discharged from the multiple water spray holes of the water faucet according to the embodiment.
Figure 10:
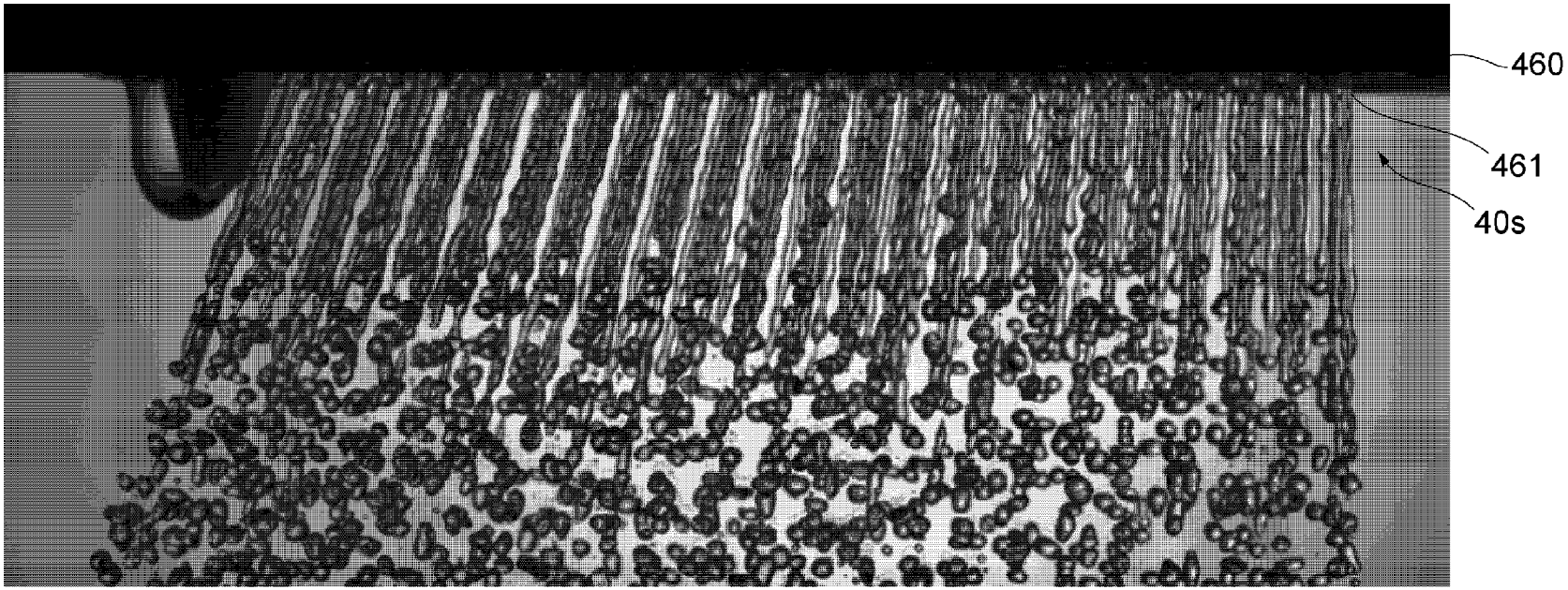
FIG. 10 is a photograph of a shower stream supplied from a shower water discharge part of the water faucet according to the embodiment.

Next, a shower stream formed of the streams discharged in this way will be described with reference to FIG. 9 and FIG. 10. FIG. 9 is photographs of the streams discharged from the multiple water spray holes of the water faucet according to the embodiment, and FIG. 10 is a photograph of the shower stream supplied from the shower water discharge part of the water faucet according to the embodiment.

The upper section of FIG. 9 shows the case where water with no bubbles entrained in it is discharged from the multiple water spray holes 461 of the water spray plate 460, while the lower section of FIG. 9 shows the case where the bubble-entrained water is discharged. Both of the photographs on the upper and lower sections of FIG. 9 were taken from a fixed point at the times from t1 to t18 (from left to right).

As shown in FIG. 9, in the case where no bubbles are entrained in the stream discharged from the multiple water spray holes 461 (upper section of FIG. 9), no change occurs in the flow velocity of the water discharged from each water spray hole, so that single streams with a substantially constant cross-sectional area are formed. Accordingly, the streams are supplied downward as single streams as they are without merging with each other.

On the other hand, in the case where the bubble-entrained water is discharged from the multiple water spray holes 461 (lower section of FIG. 9) as in the water faucet KF according to the embodiment, changes occur in the flow velocity of the individual streams and water lumps are formed. Accordingly, even one stream discharged from one water spray hole 461 varies significantly in cross-sectional area according to the portion of the stream. As can be seen, in the portions enclosed by the frame 80, where water lumps with a large cross-sectional area are created, merging between the streams discharged from the adjacent water spray holes 461 and 461 occurs and a large waterdrop WD is formed and supplied downward.

A look at this process in the entire shower water discharge part 40*s* as shown in FIG. 10 shows how the multiple streams discharged from the water spray holes 461 become multiple large waterdrops and are supplied downward from the water spray plate 460. In FIG. 9, merging of the streams discharged from the water spray holes 461 and 461 which are adjacent in the left-right direction is particularly noted; however, this merging can occur not only between the streams from the water spray holes 461 and 461 adjacent in the left-right direction but also between those from the water spray holes 461 and 461 adjacent in the front-back direction. While randomly changing the stream to merge with, the formed large waterdrops spread throughout the downstream area of the water spray plate 460.

Figure 11:
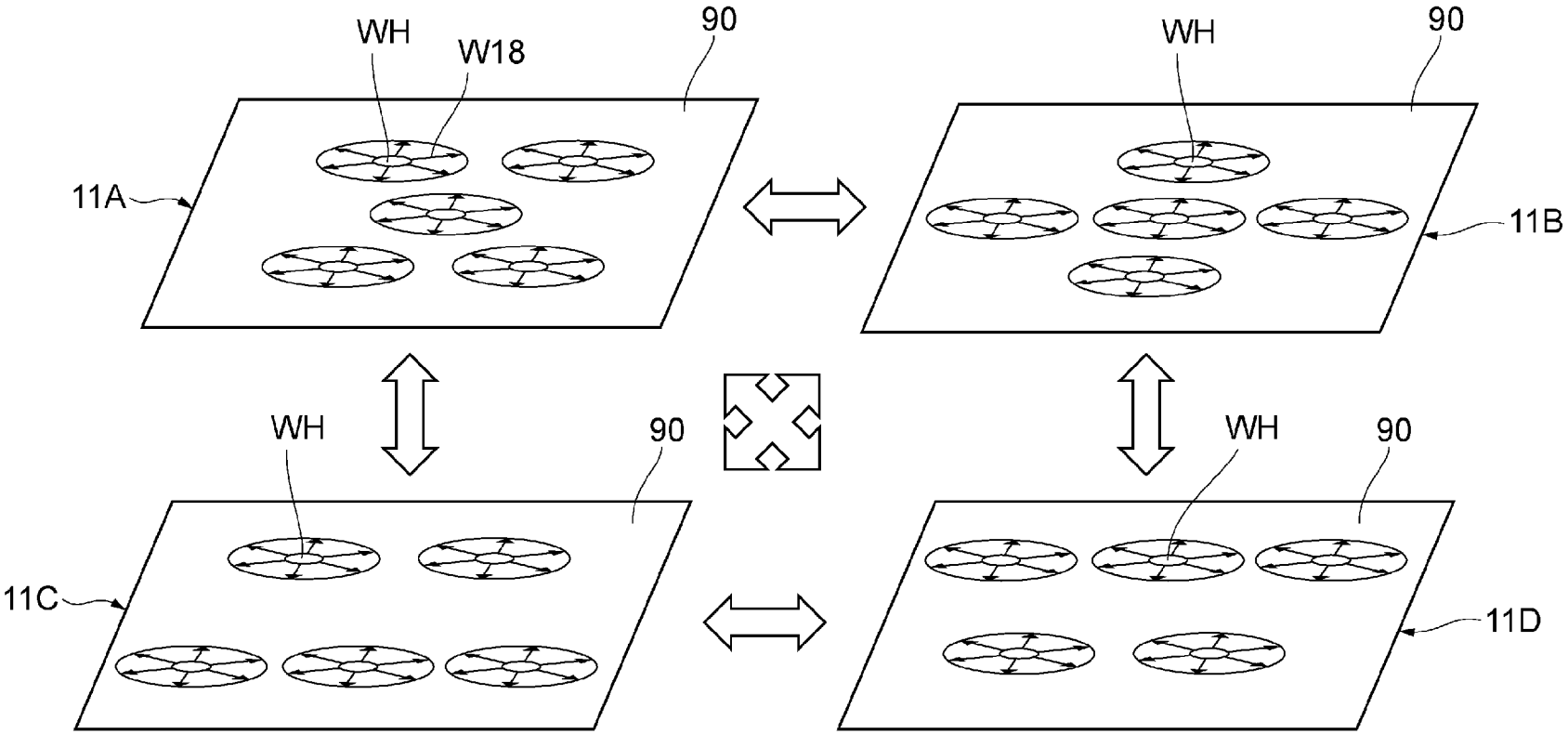
FIG. 11 is a schematic view showing changes in the landing position of the water in a piece to wash.

Next, the landing of water on a piece to wash will be described with reference to FIG. 11. FIG. 11 is a schematic view showing changes in the landing positions of water in the piece to wash.

In FIG. 11, the landing positions of the water supplied from the shower water discharge part 40*s* on the piece to wash 90 are indicated by the reference sign WH. As described above, the water lumps and waterdrops, which are discharged from the water spray holes 461 and formed by merging, randomly change in travelling direction, so that the landing positions of these water lumps and waterdrops also randomly change as shown in a state 11A to a state 11D. The water lump and waterdrops landing on a piece to wash 90 are radially diffused on the piece to wash 90 as indicated by the arrows W18.

In this way, since the water lands on the piece to wash as water lumps and waterdrops having a large cross-sectional area, it is possible to scrape off even persistent dirt adhering to the piece to wash. In addition, since changes occur in the travelling direction of the streams discharged from the water spray holes 461 when these streams merge, it is possible to land the water on the piece to wash 90 at different positions over time and wash it evenly.

The embodiment of the present invention has been described above with reference to the specific examples. However, the present invention is not limited to these specific examples. That is, embodiments conceived by a person skilled in the art making appropriate design changes to these specific examples are also encompassed in the scope of the present invention as long as such embodiments include the features of the present invention. For example, the components belonging to each of the above-described specific examples and their arrangement, materials, conditions, shapes, sizes, and the like are not limited to those illustrated but can be appropriately changed. In addition, the elements belonging to each of the above-described embodiments can be combined as far as technically possible, and combinations of these elements are also encompassed in the scope of the present invention as long as such combinations include the features of the present invention.

What is claimed is:

1. A water faucet used for a kitchen, comprising: a mounting part which is mounted on a mounting surface; a shower water discharge part, provided above the mounting part, which has multiple water spray holes and supplies multiple streams discharged from the multiple water spray holes as a shower stream obliquely downward to the front side of where a user stands; and a flow velocity changing part which changes the flow velocity of the stream discharged from each of the multiple water spray holes such that the cross-sectional area of the stream changes with time, wherein the multiple water spray holes are disposed at intervals such that, when the cross-sectional area of one stream discharged from one water spray hole exceeds a predetermined size, the one stream is merged with one of the other streams discharged from the multiple other water spray holes adjacent to the one water spray hole, and such that the one of the other streams with which the one stream merges changes with time, the flow velocity changing part has a bubble entraining part which entrains bubbles into the water on the upstream side of the multiple water spray holes to turn the water into bubble entrained water, and the bubble entraining part has: multiple injection ports which increase the flow velocity of the water supplied from the upstream side and inject the water to the downstream side as injection streams; an air suction part which suctions air by means of a negative pressure developing with the passage of the injection stream; an air entraining part which entrains the air introduced from the air suction part into the injection stream; and a throat member disposed between the multiple injection ports and the shower water discharge part, the throat member has: multiple openings disposed at the surface facing the shower water discharge part; and multiple throats which extend from all of the openings to the surface facing the multiple injection ports, and the multiple throats are disposed at a position that axially corresponds to one of the multiple injection ports such that the injection streams pass through; and wherein at least a portion of the air entraining part is positioned between the multiple throats and the shower water discharge part.

2. The water faucet according to claim 1, wherein the air entraining part merges the injection streams having passed through the multiple throats, between the multiple throats and the shower water discharge part.

3. The water faucet according to claim 2, wherein the air entraining part is disposed within the space between the multiple injection ports and the shower water discharge part, close to the shower water discharge part.

4. The water faucet according to claim 3, wherein the flow velocity changing part brings the injection streams injected from the multiple injection ports, which is provided on the upstream side of and near the shower water discharge part, into collision against an inner wall surface of the shower water discharge part.

5. The water faucet according to claim 4, wherein the multiple injection ports are disposed such that the injection streams injected by the respective injection ports collide against the inner wall surface of the shower water discharge part at different positions.

6. The water faucet according to claim 5, further comprising a backflow preventing part, which is a surface of the throat member facing the water spray hole and preventing the injection stream colliding against the inner wall surface of the shower water discharge part from flowing backward to the multiple injection ports, between the throats.

7. A water faucet used for a kitchen, comprising: a mounting part which is mounted on a mounting surface; a shower water discharge part, provided above the mounting part, which has multiple water spray holes and supplies multiple streams discharged from the multiple water spray holes as a shower stream obliquely downward to the front side of where a user stands; a flow velocity changing part which changes the flow velocity of the stream discharged from each of the multiple water spray holes such that the cross-sectional area of the stream changes with time, wherein the multiple water spray holes are disposed at intervals such that, when the cross-sectional area of one stream discharged from one water spray hole exceeds a predetermined size, the one stream is merged with one of the other streams discharged from the multiple other water spray holes adjacent to the one water spray hole, and such that the one of the other streams with which the one stream merges changes with time, the flow velocity changing part has a bubble entraining part which entrains bubbles into the water on the upstream side of the multiple water spray holes to turn the water into bubble- entrained water, the bubble entraining part has: multiple injection ports which increase the flow velocity of the water supplied from the upstream side and inject the water to the downstream side as injection streams; an air suction part which suctions air by means of a negative pressure developing with the passage of the injection stream; an air entraining part which entrains the air introduced from the air suction part into the injection stream; and a throat member disposed between the multiple injection ports and the shower water discharge part, the throat member has: multiple openings disposed at the surface facing the shower water discharge part; and multiple throats which extend from all of the openings to the surface facing the multiple injection ports, and the multiple throats are disposed at a position that corresponds to the multiple injection ports such that the injection streams pass through; and wherein at least a portion of the air entraining part is positioned between the multiple throats and the shower water discharge part.

8. The water faucet according to claim 7, wherein the air entraining part merges the injection streams having passed through the multiple throats, between the multiple throats and the shower water discharge part.

9. The water faucet according to claim 8, wherein the air entraining part is disposed within the space between the multiple injection ports and the shower water discharge part, close to the shower water discharge part.

10. The water faucet according to claim 9, wherein the flow velocity changing part brings the injection streams injected from the multiple injection ports, which is provided on the upstream side of and near the shower water discharge part, into collision against an inner wall surface of the shower water discharge part.

11. The water faucet according to claim 10, wherein the multiple injection ports are disposed such that the injection streams injected by the respective injection ports collide against the inner wall surface of the shower water discharge part at different positions.

12. The water faucet according to claim 11, further comprising a backflow preventing part, which is a surface of the throat member facing the water spray hole and preventing the injection stream colliding against the inner wall surface of the shower water discharge part from flowing backward to the multiple injection ports, between the throats.

13. A water faucet used for a kitchen, comprising:

a mounting part which is mounted on a mounting surface;

a shower water discharge part, provided above the mounting part, which has multiple water spray holes and supplies multiple streams discharged from the multiple water spray holes as a shower stream obliquely downward to the front side of where a user stands; and a flow velocity changing part which changes the flow velocity of the stream discharged from each of the multiple water spray holes such that the cross-sectional area of the stream changes with time, wherein the multiple water spray holes are disposed at intervals such that, when the cross-sectional area of one stream discharged from one water spray hole exceeds a predetermined size, the one stream is merged with one of the other streams discharged from the multiple other water spray holes adjacent to the one water spray hole, and such that the one of the other streams with which the one stream merges changes with time, the flow velocity changing part has a bubble entraining part which entrains bubbles into the water on the upstream side of the multiple water spray holes to turn the water into bubble-entrained water, the bubble entraining part has:

multiple injection ports which increase the flow velocity of the water supplied from the upstream side and inject the water to the downstream side as injection streams;

an air suction part which suctions air by means of a negative pressure developing with the passage of the injection stream;

an air entraining part which entrains the air introduced from the air suction part into the injection stream;

multiple throats which are passages being partitioned off each other by multiple wall surfaces, being formed at positions corresponding to the multiple injection ports and the injection streams pass through, wherein at least a portion of the air entraining part is positioned between the multiple throats and the shower water discharge part; and a backflow preventing part, which has a surface facing the water spray hole and preventing the injection stream colliding against the inner wall surface of the shower water discharge part from flowing backward to the multiple injection ports, between the multiple injection ports and the shower water discharge part, and between throats, the air entraining part merges the injection streams having passed through the multiple throats, and whole of the backflow preventing part is disposed at a position which is the shower water discharge part side of a medial position between downstream side end of the injection part and an inner surface of the shower water discharge.

14. The water faucet according to claim 13, wherein the air entraining part is disposed within the space between the multiple injection ports and the shower water discharge part, close to the shower water discharge part.

15. The water faucet according to claim 14, wherein the flow velocity changing part brings the injection streams injected from the multiple injection ports, which is provided on the upstream side of and near the shower water discharge part, into collision against an inner wall surface of the shower water discharge part.

16. The water faucet according to claim 15, wherein the multiple injection ports are disposed such that the injection streams injected by the respective injection ports collide against the inner wall surface of the shower water discharge part at different positions.

17. The water faucet according to claim 16, further comprising a backflow preventing part, which is a surface of the throat member facing the water spray hole and preventing the injection stream colliding against the inner wall surface of the shower water discharge part from flowing backward to the multiple injection ports, between the throats.

* * * * *